US005131352A

United States Patent [19]

Hoshino et al.

[11] Patent Number: 5,131,352

[45] Date of Patent: Jul. 21, 1992

[54] COOLING FAN APPARATUS FOR AN AUTOMOBILE

[75] Inventors: Yoshitake Hoshino, Kariya; Takaaki Sakane, Nagoya; Yasuaki Hasebe, Obu, all of Japan

[73] Assignee: Nippondenso Co., Ltd., Kariya, Japan

[21] Appl. No.: 747,951

[22] Filed: Aug. 21, 1991

[30] Foreign Application Priority Data

Sep. 3, 1990 [JP] Japan ..... 2-233566

[51] Int. Cl.[5] ..... F01P 7/10

[52] U.S. Cl. ..... 123/41.49; 416/247 R

[58] Field of Search ..... 123/41.11, 41.48, 41.49; 415/121.2; 416/247 R

[56] References Cited

U.S. PATENT DOCUMENTS 4,522,160 6/1985 Speers et al. ..... 123/41.49

4,592,437 6/1986 Holm et al. ..... 180/68.6

4,776,m755 10/1988 Björkestam et al. ..... 415/121.2

5,002,019 3/1991 Klaucke et al. ..... 123/41.49

FOREIGN PATENT DOCUMENTS 61-175222 8/1986 Japan .

62-162719 7/1987 Japan .

936865 9/1963 United Kingdom ..... 416/247

*Primary Examiner*—Noah P. Kamen

*Attorney, Agent, or Firm*—Cushman, Darby & Cushman

[57] ABSTRACT

A cooling fan apparatus having a cooling fan, a fan shroud and a screen. The screen comprises a bell mouth ring and a screen portion. A bell mouth ring is disposed in front of the fan shroud by a predetermined distance. The screen portion comprises a plurality of rings and a radial grid disposed around the rings at the periphery of the screen.

11 Claims, 9 Drawing Sheets

COOLING FAN APPARATUS FOR AN AUTOMOBILE

BACKGROUND OF THE INVENTION

1. Field of the Invention

The present invention relates to a cooling fan apparatus for an automobile, especially to a cooling fan, a fan shroud and a protecting screen for a cooling fan, which are located in front of a radiator in the engine compartment of an automobile.

2. Background Information

A cooling fan is disposed in front of a radiator, which is used to cool engine coolant, and a condenser, which is used to condense refrigerant of an air conditioner.

FIG. 12 shows a conventional cooling fan apparatus. A cooling fan 2 is located in front of the condenser 1 where the left of the Figure is closest to the front of the automobile. The cooling fan has a boss 3 at the center of the fan, wherein an electric motor 4 is disposed. A fan shroud 5 is disposed around the cooling fan 2. A screen 6 is connected to the fan shroud 5 at a front end thereof. A bracket 7, which is formed integrally with the fan shroud 5, is disposed at a center portion of the screen 6. The electric motor 4 has a hub 8 which is connected to the bracket 7 through a rivet 9, so that the electric motor 4 is fixed on the center axis of the protecting screen 6.

As shown in FIG. 13, the screen 6 has a plurality of rings 10 which are disposed concentrically from an outer periphery to an inner periphery of the protecting screen 6.

An object of this invention is to reduce the noise and increase the cooling efficiency of the operating fan.

During research it was noticed that turbulence of air flow through the fan shroud 5, is one cause of fan noise. The air turbulence around the screen increases when the automobile is stopped, namely when the engine is idling, because the cooling fan forcefully draws air into the engine compartment. As shown in FIG. 15, an early improvement was to make a clearance X between the fan shroud 5 and the screen 6 in order to smooth the air flow. The noise level was reduced 0.5 dB.

According to the result of the improvement described above, the inventors disposed a bell mouth ring 11 at the outer periphery of the screen 6, as shown in FIG. 16, in order to further smooth the air flow which flows through the clearance X. The noise of the cooling fan 2 shown in FIG. 16 is 0.9 dB less than that of the cooling fan 2 shown in FIG. 15 In addition, the amount of air flowing through the cooling fan 2 shown in FIG. 16 is increased by about 5% over that of cooling fan 2 shown in FIG. 15. Additional improvements are also possible.

Air turbulence over the rings of the screen can be reduced. The cooling fan shown in FIG. 13 has protective rings 10 up to the outer periphery of the screen. The air turbulence resulting from the rings is significant especially in the vicinity of the outer periphery of the screen 6. As shown in FIG. 17, the air flow is disturbed behind ring 10*a* and ring 10*b* which are disposed at the outer periphery of the screen 6. In order to reduce such air turbulence, a radial grid 12 is disposed at the peripheral portion of the screen 6 as shown in FIG. 18, reducing the noise level by 0.6 dB as compared with the cooling fan 2 shown in FIG. 16.

SUMMARY OF THE INVENTION

An object of the present invention is to reduce noise generated by the screen and to increase the amount of air which flows through the cooling fan.

According to the present invention, a cooling fan apparatus has a fan shroud around a cooling fan and a screen located in front of the fan shroud by a predetermined distance. The screen has a bell mouth ring along the outer periphery. The opening area of the bell mouth ring gradually decreases near the fan shroud. The air flows along the outer surface of the bell mouth ring without turbulence, reducing noise while increasing the amount of air supplied by the cooling fan.

DETAILED DESCRIPTION OF THE PREFERRED EMBODIMENT

Figure 6:
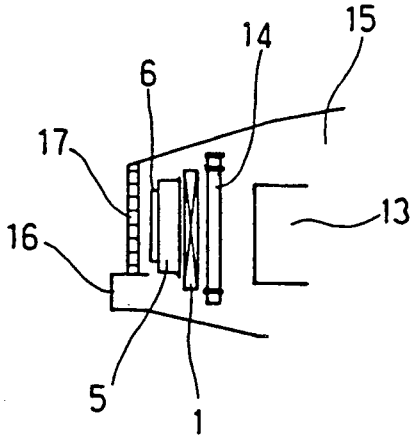
FIG. 6 is a schematical view showing a cooling fan apparatus disposed in an engine compartment of an automobile.

FIG. 6 shows a cooling fan apparatus disposed in an engine compartment 15. A radiator 14 for cooling engine coolant is disposed in front of an engine 13. A condenser 1 for condensing air conditioning refrigerant is disposed in front of the radiator 14. A cooling fan, a fan shroud 5 and a screen 6 are disposed in front of the condenser 1. A bumper 16 and a radiator grille 17 are provided at a front portion of the automobile.

Figure 7:
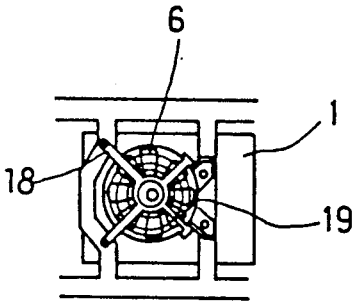
FIG. 7 is a front view showing a cooling fan apparatus disposed in an engine compartment of an automobile.

As shown in FIG. 7, the screen 6 is connected to the fan shroud 5 through a stay, and the fan shroud 5 is connected to a body of the automobile through a stay 18 and to the condenser 1 through a stay 19.

Figure 1:
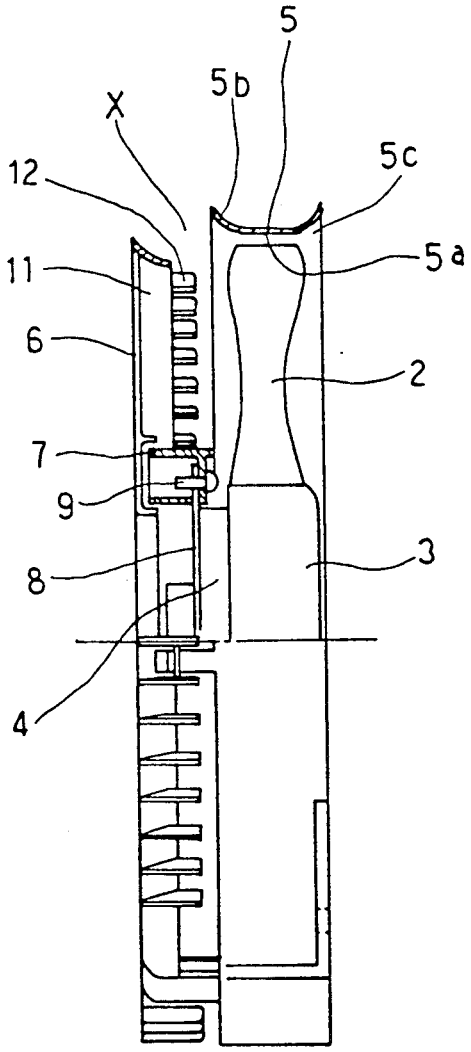
FIG. 1 is a partial cross-sectional view showing a cooling fan apparatus according to the present invention.

A detailed structure of the cooling fan apparatus is shown in FIG. 1.

The cooling fan 2 has a boss 3 on the central axis thereof. The boss 3 contains an electric motor 4. A hydraulic motor can be used to drive the cooling fan instead of the electric motor. The fan shroud 5 is disposed around the cooling fan 2. The fan shroud 5 comprises a cylindrical portion 5*a* surrounding the perimiter of the cooling fan 2, a flared intake duct 5*b*, and a flared skirt portion 5*c*. The cylindrical portion 5*a*, the intake duct 5B and the skirt portion 5*c* are integrally formed and made of fiber reinforced resin such as polypropylene.

The protecting screen 6 is located in front of the intake duct 5*b* by a distance X, which is about 2 cm. The screen 6 has a bell mouth ring 11 at the outer periphery. The opening area of the bell mouth ring 11 is flared outward towards the front of the automobile. The outer and inner surfaces of the bell mouth ring 11 are smooth curved surfaces. A bracket 7, which is formed integrally with the fan shroud 5, is connected to the screen 6 at the center portion thereof. A hub 8 of the electric motor 4 is fixed to the bracket 7 through the rivet 9. Therefore, the electric motor 4 and the cooling fan 2 are connected to the screen 6 through the bracket 7. The screen is made of fiber reinforced resin such as polypropylene.

Figure 2:
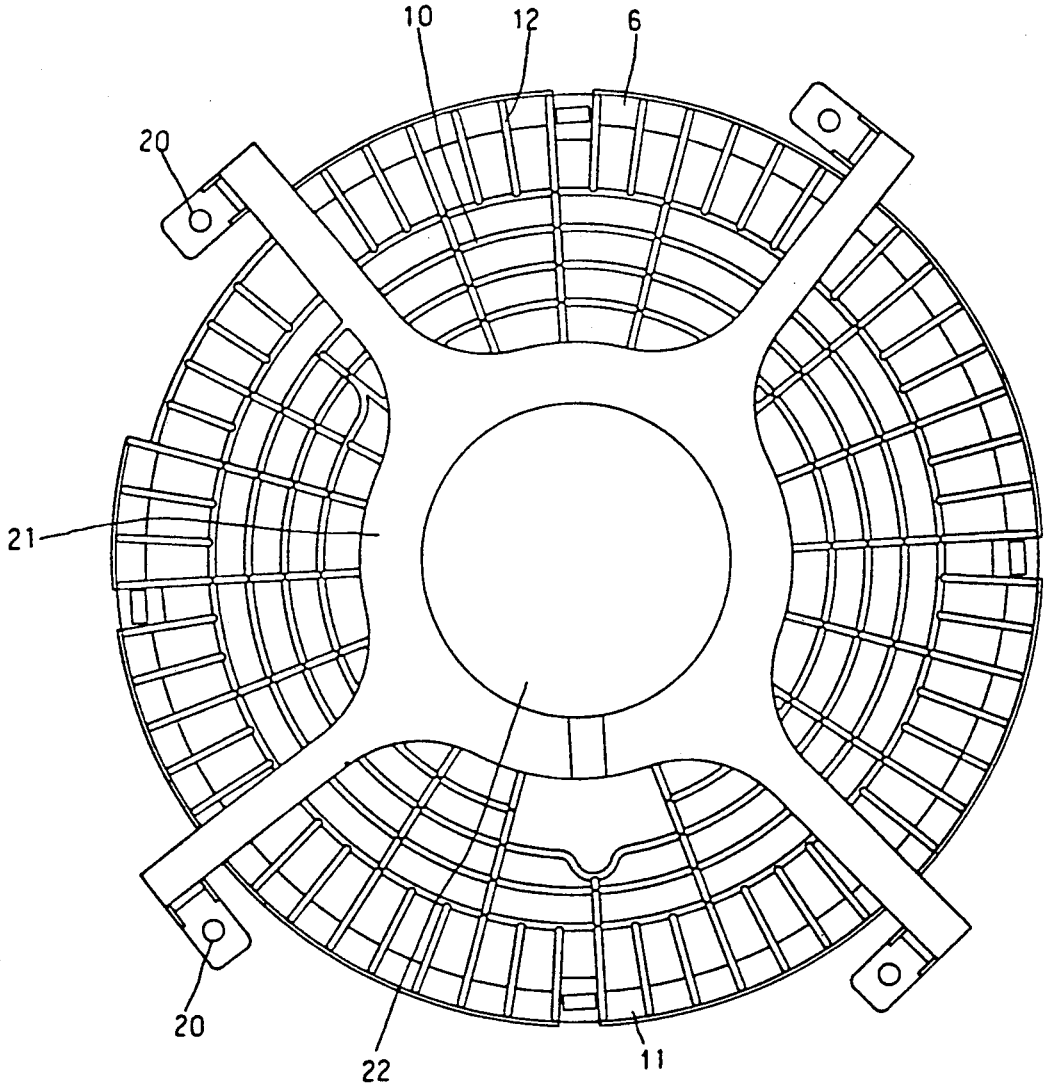
FIG. 2 is a front view of a screen.
Figure 3:
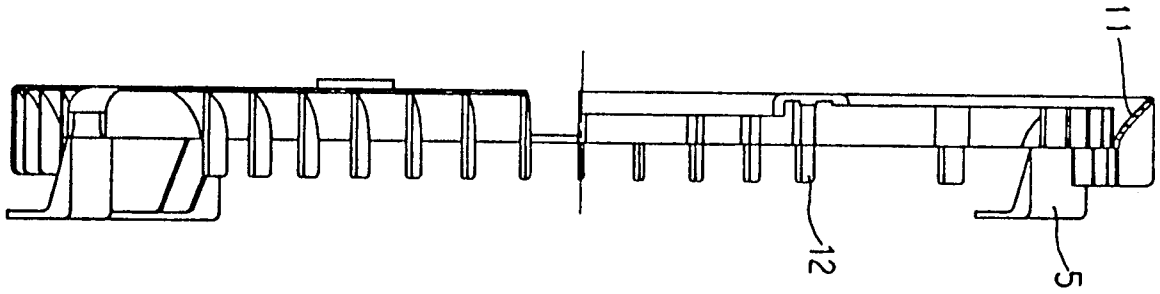
FIG. 3 is a partial cross-sectional side view of a screen.

FIG. 2 is a front view of the screen 6 and FIG. 3 is a side view of the screen 6. A radial grid 12, which comprises a plurality of radial ribs, is provided along the inner surface of the bell mouth ring 11. The radial ribs of the radial grid 12 stand evenly spaced and radially side by side. A plurality of rings 10 (four rings in this embodiment) are provided at the inner side of the radial grid 12. Both the rings 10 and the radial grid 12 protect the cooling fan 2 from foreign objects.

The screen 6 has four stays 20 integrally connected to the fan shroud 5. A holding ring 21 is provided at the center portion of the four stays 20, into which the bracket 7 is inserted firmly. The air flows toward the electric motor 4 through an opening space 22 of the holding ring 21.

Figure 4:
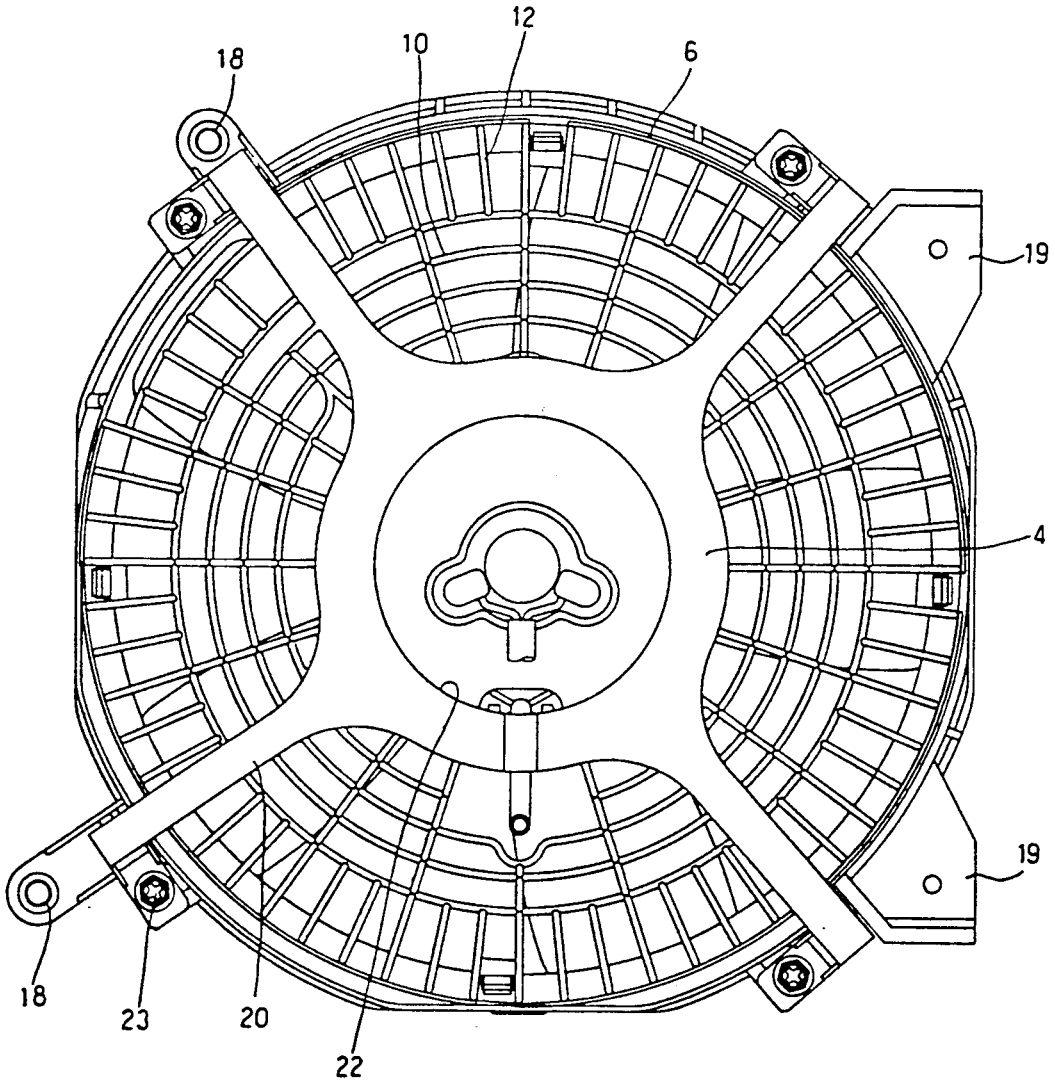
FIG. 4 is a front view of a cooling fan apparatus according to the present invention.

FIG. 4 shows the screen 6, the electric motor 4 and the fan shroud 5, which are assembled to each other. The screen 6 is connected to the fan shroud 5 through the stays 20 and bolts 23. The fan shroud 5 has stays 18 through which the fan shroud 5 is connected to the body of the automobile. The fan shroud 5 also has stays 19 through which the fan shroud 5 is connected to the condenser 1.

Figure 5:
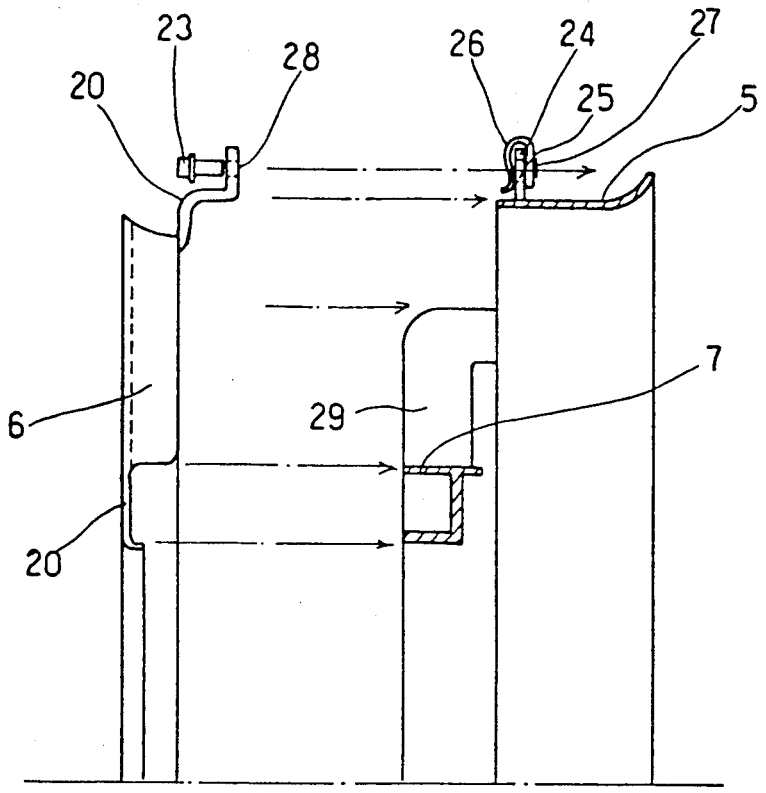
FIG. 5 is an exploded view of a cooling fan apparatus according to the present invention.

FIG. 5 is an exploded view of the screen 6 and the fan shroud 5. The fan shroud 5 has a connecting portion 24 which has a through hole 25 for receiving the bolt 23. A clip 26 made of spring steel is provided on the connecting portion 27 which is confronted with the through hole 25. The bolt 23 is screwed to the washer portion 27 of the clip 26 through a through hole 28 of the stay 20 and a through hole 25 of the connecting portion 24. The fan shroud 5 has radial stays 29 which are fitted into the inside of the stays 20 of the screen 6, so that the screen 6 and the fan shroud 5 are connected to each other. The bracket 7 is provided on the stays 29.

Figure 13:
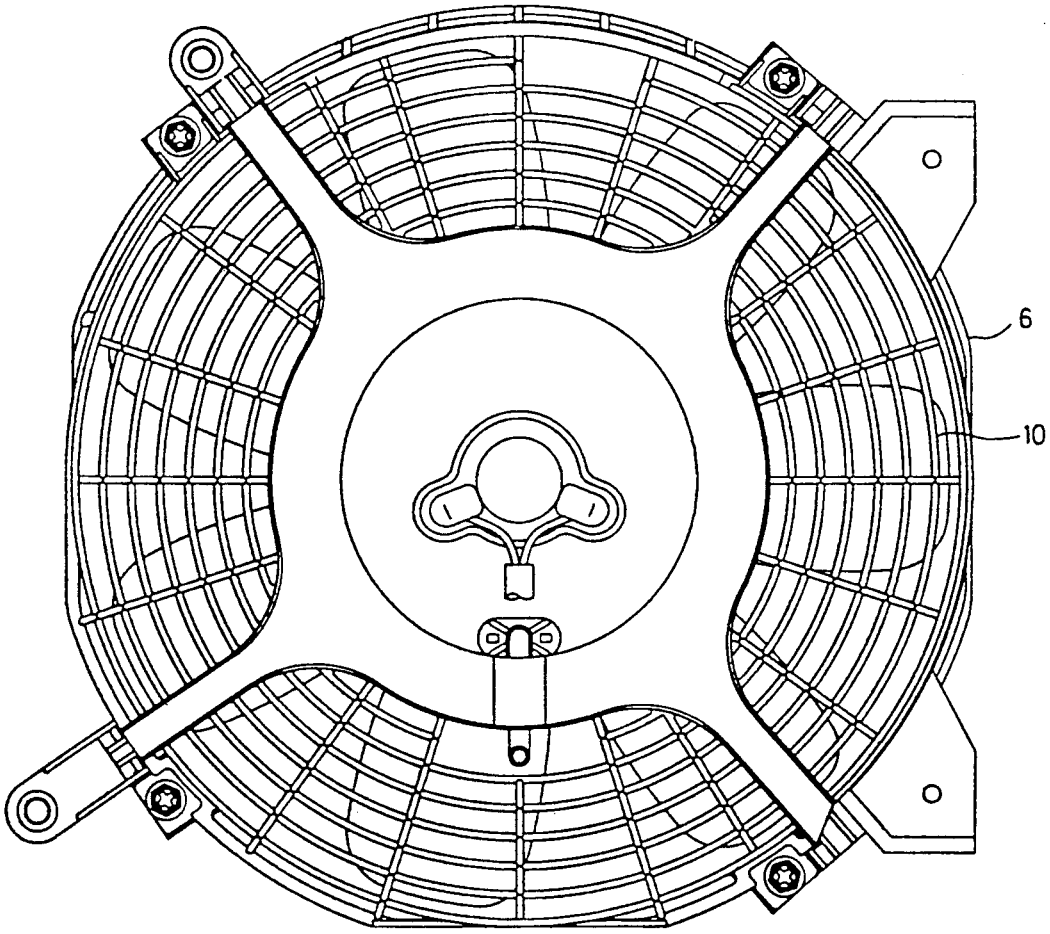
FIG. 13 is a front view of the prior art cooling fan apparatus shown in FIG. 12.
Figure 14:
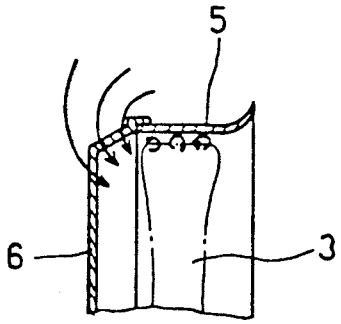
FIG. 14 through 18 are schematic views for explaining the background of the present invention.
Figure 15:
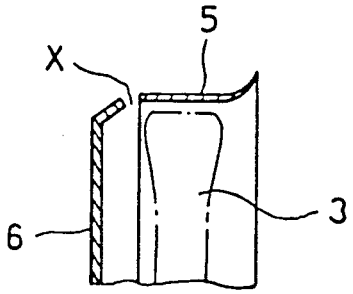
Figure 16:
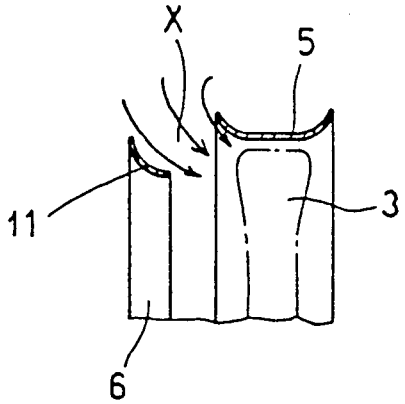
Figure 17:
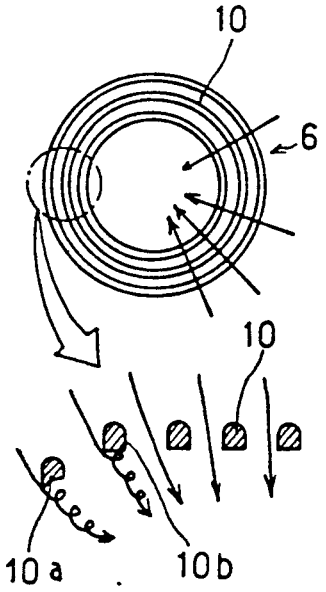
Figure 18:
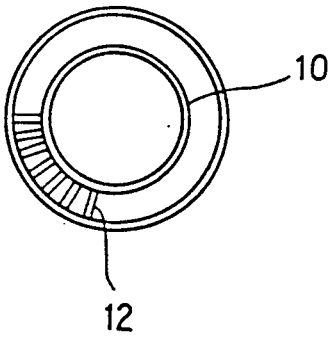

The comparison of noise reduction between the cooling fan shown in FIG. 4 and the cooling fan shown in FIG. 13 is described hereinafter.

Figure 8:
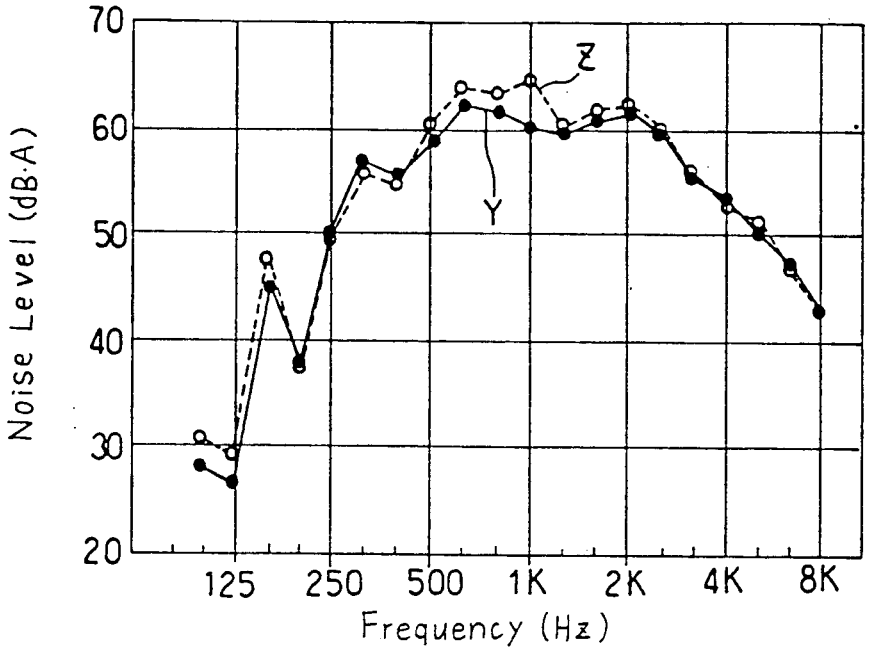
FIG. 8 and FIG. 9 are diagrams showing the noise reduction effects of a cooling fan apparatus of the present invention.

FIG. 8 shows a relation between noise level and noise frequency, wherein the consumed energy of the electric motor 4 is 80 watts and the cooling fan rotates at the speed of 2000 r.p.m. Line Y represents a cooling fan apparatus according to the present invention and broken line 2 represents the prior art apparatus shown in FIG. 13. It is apparent from FIG. 8 that a noise reduction is achieved over the whole range of noise frequency.

Figure 9:
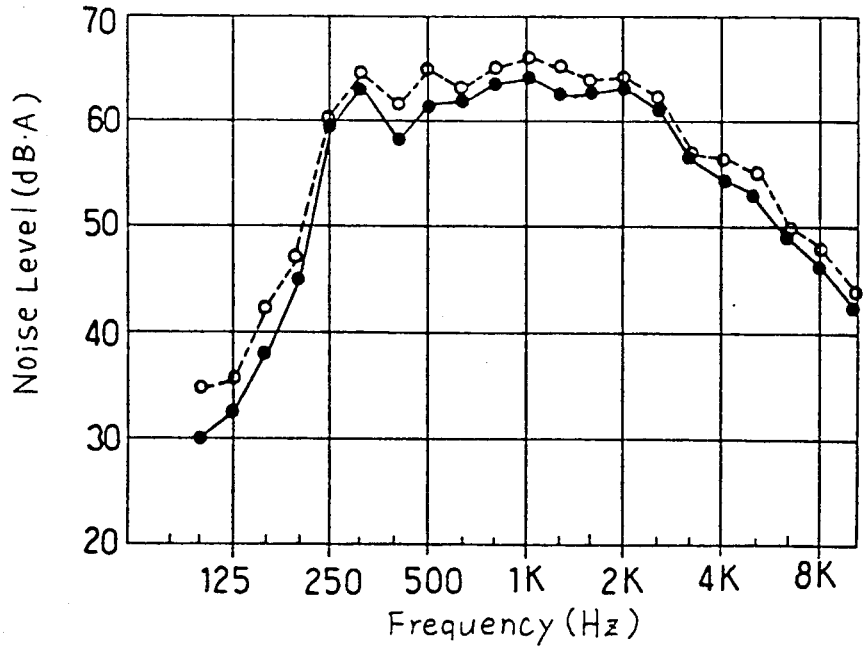

FIG. 9 is a diagram corresponding to FIG. 8, wherein the consumed energy of the electric motor 4 is 120 watts and the cooling fan rotates at the speed of 2000 r.p.m. The effect of noise reduction is greater in FIG. 9 than in FIG. 8.

According to the experiment shown in FIG. 8, the noise is reduced about 2 dB and the air flow is increased about 5%. According to another experiment shown in FIG. 9, the noise is reduced about 2.3 dB and the air flow is increased about 5%.

Figure 10A:
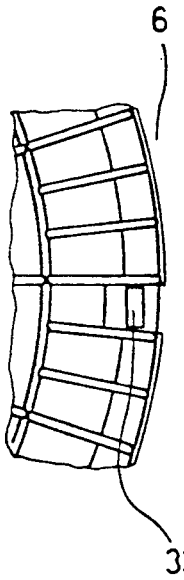
FIG. 10(*a*), (*b*) and (*c*) are front views of another embodiment of the present invention.
Figure 10B:
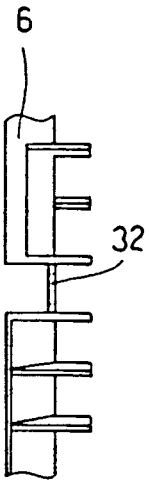
Figure 10C:
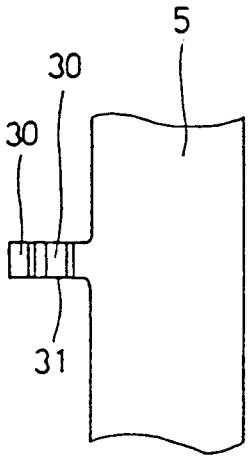
Figure 11:
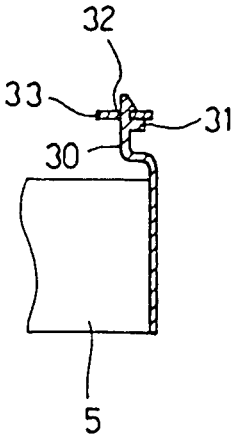
FIG. 11 is a cross-sectional view of a prior art cooling fan apparatus.
Figure 12:
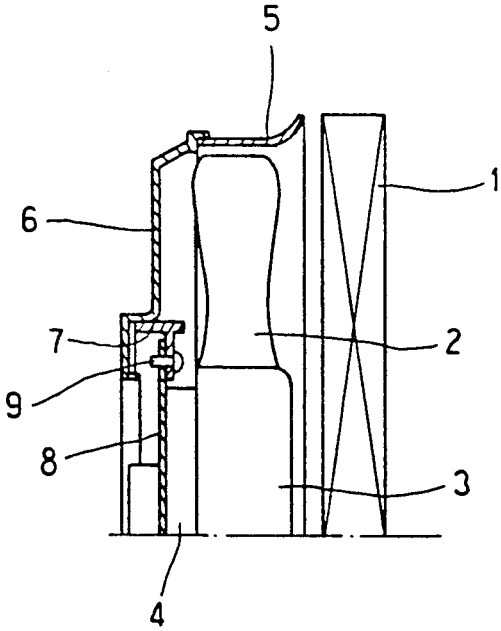
FIG. 12 is a cross-sectional view of a prior art cooling fan apparatus.

In the embodiment described above, the screen 6 and the fan shroud 5 are connected to each other by a clip 26 as shown in FIG. 5. In another embodiment, the fan shroud 5 is connected to the screen 6 directly by an elastic resin material as shown in FIG. 10(*a*), (*b*) and (*c*). The fan shroud 5 has integral tongue portions 30 each of which includes a nail portion 31 The screen 6 has receiving holes 32 for receiving the nail portion 30 therein. The tongue portion 30 is inserted into the inside of the screen 30 and the nail portion 31 is inserted into the receiving hole 32 formed on a fixing portion 33 composed of an elastic resin material.

This embodiment is just one example of the embodiments possible within the scope of this invention. Many variations can be made to the described embodiments that are still within the broad scope of the invention to reduce the turbulence and noise associated with cooling fans.

What is claimed is:

1. A cooling fan apparatus for an automobile, which is disposed in front of a radiator comprising:

a cooling fan for introducing cooling air toward said radiator;

a fan shroud disposed around said cooling fan for guiding the cooling air; and a screen disposed in front of said fan shroud for protecting the cooling fan;

said screen having a flared bell mouth ring and a screen portion disposed inside of said bell mouth ring for preventing foreign objects from passing through the bell mouth ring.

2. A cooling fan apparatus for an automobile claimed in claim 1, wherein said screen portion comprises a plurality of rings disposed concentrically and a radial grid disposed around said rings.

3. A cooling fan apparatus for an automobile claimed in claim 1 or 2, wherein said screen has integral stays which protrude form the outer surface of said bell mouth ring toward said fan shroud, and said screen and the fan shroud are connected to each other through said stays.

4. A cooling fan apparatus for an automobile claimed in claim 1 or 2, wherein said cooling fan is driven by an electric motor which is disposed on a center axis of the cooling fan and is fixed to a center portion of said screen.

5. A cooling fan for apparatus for an automobile claimed in claim 3, wherein said cooling fan is driven by an electric motor which is disposed on a center axis of the fan is fixed to a center portion of said screen.

6. A cooling fan apparatus for an automobile claimed in claim 1 or claim 2, wherein said bell mouth ring is disposed in front of said fan shroud by a predetermined distance.

7. A cooling fan apparatus for an automobile claimed in claim 6, wherein said predetermined distance is approximately 2 cm.

8. A cooling fan apparatus for an automobile claimed in claim 7, wherein said screen has integral stays which protrude from the outer surface of said bell mouth ring toward said fan shroud, and the screen and fan shroud are connected to each other through said stays.

9. A cooling fan apparatus for an automobile claimed in claim 7, wherein said cooling fan is driven by an electric motor which is disposed on a center axis of the fan and is fixed to a center portion of said screen.

10. A cooling fan apparatus for an automobile claimed in claim 6, wherein said screen has integral stays which protrude from the outer surface of said bell mouth ring toward said fan shroud, and the screen and fan shroud are connected to each other through said stays.

11. A cooling fan apparatus for an automobile claimed in claim 6, wherein said cooling fan is driven by an electric motor which is disposed on a center axis of the fan and is fixed to a center portion of said screen.

* * * * *